US007473124B1

(12) United States Patent
Briant et al.

(10) Patent No.: US 7,473,124 B1
(45) Date of Patent: Jan. 6, 2009

(54) ELECTRICAL PLUG ASSEMBLY WITH BI-DIRECTIONAL PUSH-PULL ACTUATOR

(75) Inventors: Eric David Briant, Dillsburg, PA (US); Robert Harrison Wertz, Jr., Mechanicsburg, PA (US); Daniel Lee Gorenc, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/040,395

(22) Filed: Feb. 29, 2008

(51) Int. Cl.
*H01R 13/627* (2006.01)

(52) U.S. Cl. ..... 439/352; 439/483

(58) Field of Classification Search ..... 439/352, 439/489

See application file for complete search history.

(56) References Cited

U.S. PATENT DOCUMENTS

| | | | | |
|---|---|---|---|---|
| 5,330,366 | A | 7/1994 | Tsuji | |
| 5,564,939 | A | 10/1996 | Maitani et al. | |
| 6,371,787 | B1 | 4/2002 | Branch et al. | |
| 6,589,066 | B1 * | 7/2003 | Wu | 439/352 |
| 6,702,603 | B2 * | 3/2004 | Wu | 439/352 |
| 6,881,095 | B2 | 4/2005 | Murr et al. | |
| 6,887,091 | B1 * | 5/2005 | Wu | 439/352 |
| 6,966,790 | B2 | 11/2005 | Roese | |
| 7,147,502 | B1 * | 12/2006 | Wu | 439/352 |
| 7,160,135 | B1 | 1/2007 | Wu | |
| 7,207,823 | B1 * | 4/2007 | Yang | 439/352 |
| 7,238,040 | B1 * | 7/2007 | Wu | 439/352 |
| 7,281,937 | B2 | 10/2007 | Reed et al. | |
| 7,281,938 | B1 * | 10/2007 | Wu | 439/353 |
| 7,309,250 | B2 * | 12/2007 | Reed et al. | 439/352 |
| 7,318,740 | B1 | 1/2008 | Henry et al. | |
| 7,322,845 | B2 * | 1/2008 | Regnier et al. | 439/352 |
| 7,354,292 | B1 * | 4/2008 | Lloyd et al. | 439/352 |
| 2004/0023546 | A1 * | 2/2004 | Wu | 439/352 |
| 2006/0189197 | A1 * | 8/2006 | Reed et al. | 439/352 |
| 2007/0243749 | A1 * | 10/2007 | Wu | 439/352 |

* cited by examiner

*Primary Examiner*—T C Patel
*Assistant Examiner*—Harshad C Patel

(57) ABSTRACT

An electrical plug assembly includes a housing, a latch and an actuator. The housing extends along a longitudinal axis and is configured to mate with a receptacle assembly. The latch is movably coupled to the housing and has a latching end configured to latch and unlatch the receptacle assembly. The actuator is interconnected with the housing and the latch. The actuator is movable in both a push direction and a pull direction. The actuator raises the latching end when the actuator is pushed along the longitudinal axis in the push direction. The actuator also raises the latching end when the actuator is pulled along the pull direction.

20 Claims, 6 Drawing Sheets

ELECTRICAL PLUG ASSEMBLY WITH BI-DIRECTIONAL PUSH-PULL ACTUATOR

BACKGROUND OF THE INVENTION

The subject matter herein generally relates to plugs for electrical connectors and, more particularly, to an electrical connector plug having an actuator for operating a latch that secures the plug to a mating receptacle.

Various types of plugs have been proposed for electrical connectors such as external mini-SAS connectors. The plugs are inserted into corresponding receptacles to communicate data. Existing plugs include a mating end that is plugged into the receptacle and hooks that fit into holes in the receptacle to securely hold the plug in the receptacle. The plug is unlatched from the receptacle by raising the hooks out of the holes in the receptacle and removing the plug.

Existing plugs are configured to raise and lower the hooks of the plugs, relative to the receptacles, by actuating a tab or other handle on the plug. The hooks in some plugs are raised when the handle is pushed (referred to as "push-only plugs").

The hooks in other plugs are raised when the handle is pulled (referred to as "pull-only plugs"). As a result, a user of the plugs cannot switch between pushing and pulling the handles of the plugs to latch the hooks.

The inability of existing plugs to permit unlatching the plugs with corresponding receptacles by only pushing or pulling the plug's handle (but not both) can make it difficult to use the plugs in certain spaces. For example, the location of certain receptacles can make grasping and pulling the handle of a plug to unlatch the latch with the receptacle very difficult. The opposite situation may also be true—certain locations of a receptacle can make it difficult to push a plug's handle to unlatch the plug with the receptacle. In these situations, only one of the push-type or pull-type plugs may be used and the other type of plug may be too difficult to use. As a result, many plugs become too difficult to use in certain spaces.

Thus, a need exists for a plug for an electrical connector that provides the option of disengaging the plug with a receptacle by both pushing and pulling a handle or tab of the plug. That is, a need exists for a plug that is interchangeable as both a pull-type and a push-type plug.

BRIEF DESCRIPTION OF THE INVENTION

In one embodiment, an electrical plug assembly is provided. The plug assembly includes a housing, a latch and an actuator. The housing extends along a longitudinal axis and is configured to mate with a receptacle assembly. The latch is movably coupled to the housing and has a latching end configured to latch and unlatch the receptacle assembly. The actuator is interconnected with the housing and the latch. The actuator is movable in both a push direction and a pull direction. The actuator raises the latching end when the actuator is pushed along the longitudinal axis in the push direction. The actuator also raises the latching end when the actuator is pulled along the pull direction.

Optionally, one of the latch and actuator includes a driven member and the other of the latch and actuator includes a guide track. The guide track moves along the driven member and the driven member moves partially upward out of the guide track when one of the opposing ends of the guide track reaches the driven member. The driven member forces the latch to unlatch from the receptacle assembly when the driven member moves partially upward out of the guide track.

In another embodiment, another electrical plug assembly is provided. The plug assembly comprises a latching end and an actuator. The latching end is configured to latch with a receptacle assembly. The actuator is disposed between a housing and a latch of the plug assembly. The actuator is movable in both a push direction and a pull direction. The actuator unlatches the latching end from the receptacle assembly when the actuator is pushed in a push direction along a longitudinal axis of the electrical plug assembly. The actuator also unlatches the latching end from the receptacle assembly when the actuator is pulled in a pull direction along the longitudinal axis.

Optionally, the plug assembly includes a spring that moves the actuator in the pull direction to latch the latching end to the receptacle assembly after the actuator is pushed in the push direction and that moves the actuator in the push direction to latch the latching end to the receptacle assembly after the actuator is pulled in the pull direction.

In another embodiment, another electrical plug assembly is provided. The plug assembly comprises a latch and a guide track. The latch is connected to a latching end. The latching end is configured to latch with a receptacle assembly. The guide track is movable along a longitudinal axis of the electrical plug assembly in a push direction and in a pull direction. The guide track unlatches the latching end from the receptacle assembly when the guide track is moved in the push direction and when the guide track is moved in the pull direction.

DETAILED DESCRIPTION OF THE INVENTION

Figure 1:
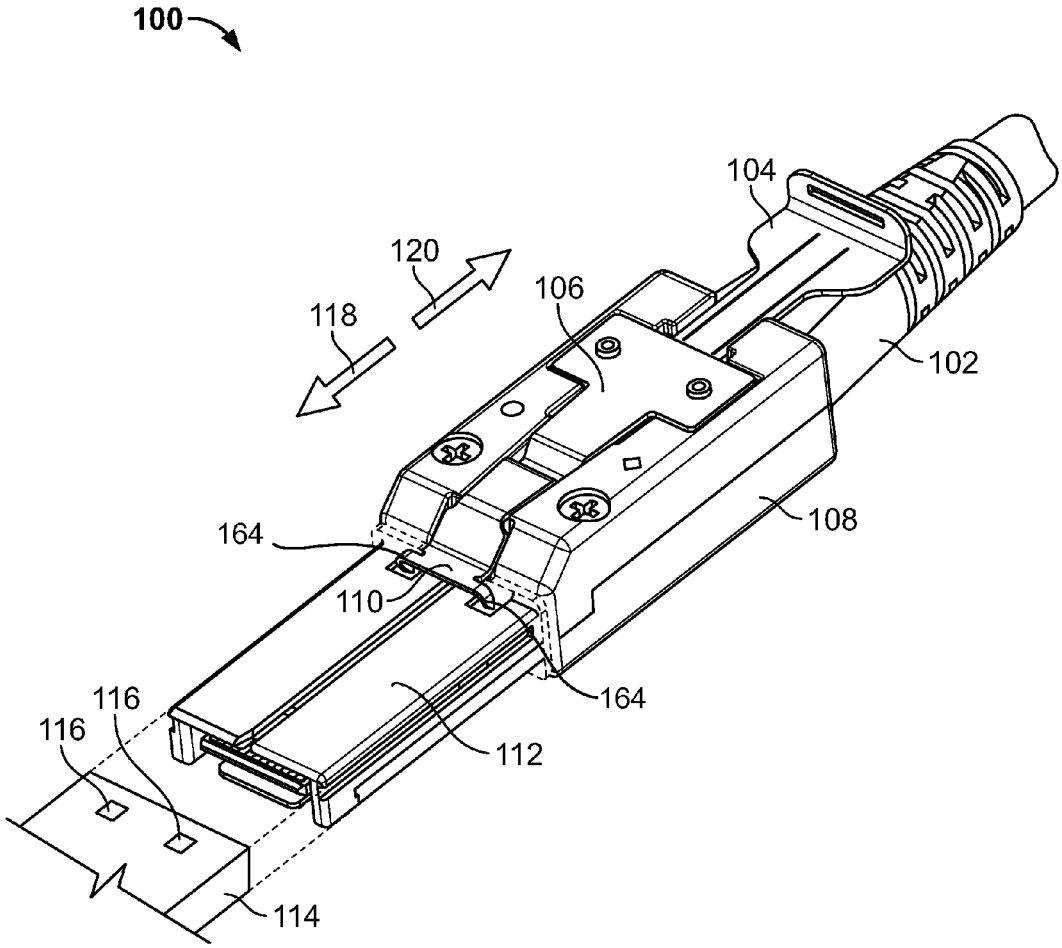
FIG. 1 is a perspective view of a bi-directional push/pull electrical plug assembly formed according to one embodiment.

FIG. 1 is a perspective view of a bi-directional push/pull electrical plug assembly 100 formed according to one embodiment. The assembly 100 includes an actuator 104 located between a latch 106 and a housing 108. The housing 108 extends along a longitudinal direction and terminates in a mating end 112. The mating end 112 is configured to be inserted into a receptacle 114. A pair of hook elements 164 connected to a latching end 110 of the latch 106 latches with a pair of holes 116 in the receptacle 114 to secure the assembly 100 to the receptacle 114. A terminating end 102 of the housing 108 is provided at the end of a cable to communicate data from a device connected to the cable to the receptacle 114 via the plug assembly 100.

In operation, the actuator 104 may be moved in two diametrically opposed directions along the longitudinal axis of the housing 108. Specifically, the actuator 104 can be pushed in a push direction 118 and pulled in a pull direction 120 to raise the latching end 110 of the latch 106.

If the mating end 112 is mated with the receptacle 114 and the latching end 110 of the latch 106 is lowered to engage the hook elements 164 with the holes 116 in the receptacle 114, the latching end 110 is raised to disengage the hook elements 164 from the holes 116 in the receptacle 114 and the mating end 112 of the assembly 100 can be removed from the receptacle 114. The actuator 104 is then released, which causes the latching end 110 to lower.

If the mating end 112 is not mated with the receptacle 114, the mating end 112 is inserted into the receptacle 114. When the latching end 110 contacts the receptacle 114, the latching end 110 is forced partially upwards until the hook elements 164 of the latching end 110 lower into the holes 116 of the receptacle 114 to secure the assembly 100 with the receptacle 114. Therefore, in one embodiment, the actuator 104 does not require movement in either the push direction 118 or pull direction 120 to latch the latching end 110 with the receptacle 114.

While FIG. 1 illustrates a mini-Serial Attached SCSI ("SAS") plug assembly, the bi-directional push/pull plug assembly 100 can be used with a variety of electrical connectors. For example, the assembly 100 may represent a Small Form-Factor Pluggable ("SFP") connector, a micro ribbon, or CHAMP, connector, a channel max connector, a Quad Small Form-Factor Pluggable ("QSFP") connector, an SFP+ connector, and the like. The mini-SAS plug assembly illustrated in FIG. 1 is thus merely illustrative and not restrictive. Moreover, the term "electrical connectors" includes any connector capable of communicating data. For example, an electrical connector for a fiber optic cable may be used in conjunction with the assembly 100.

Figure 2:
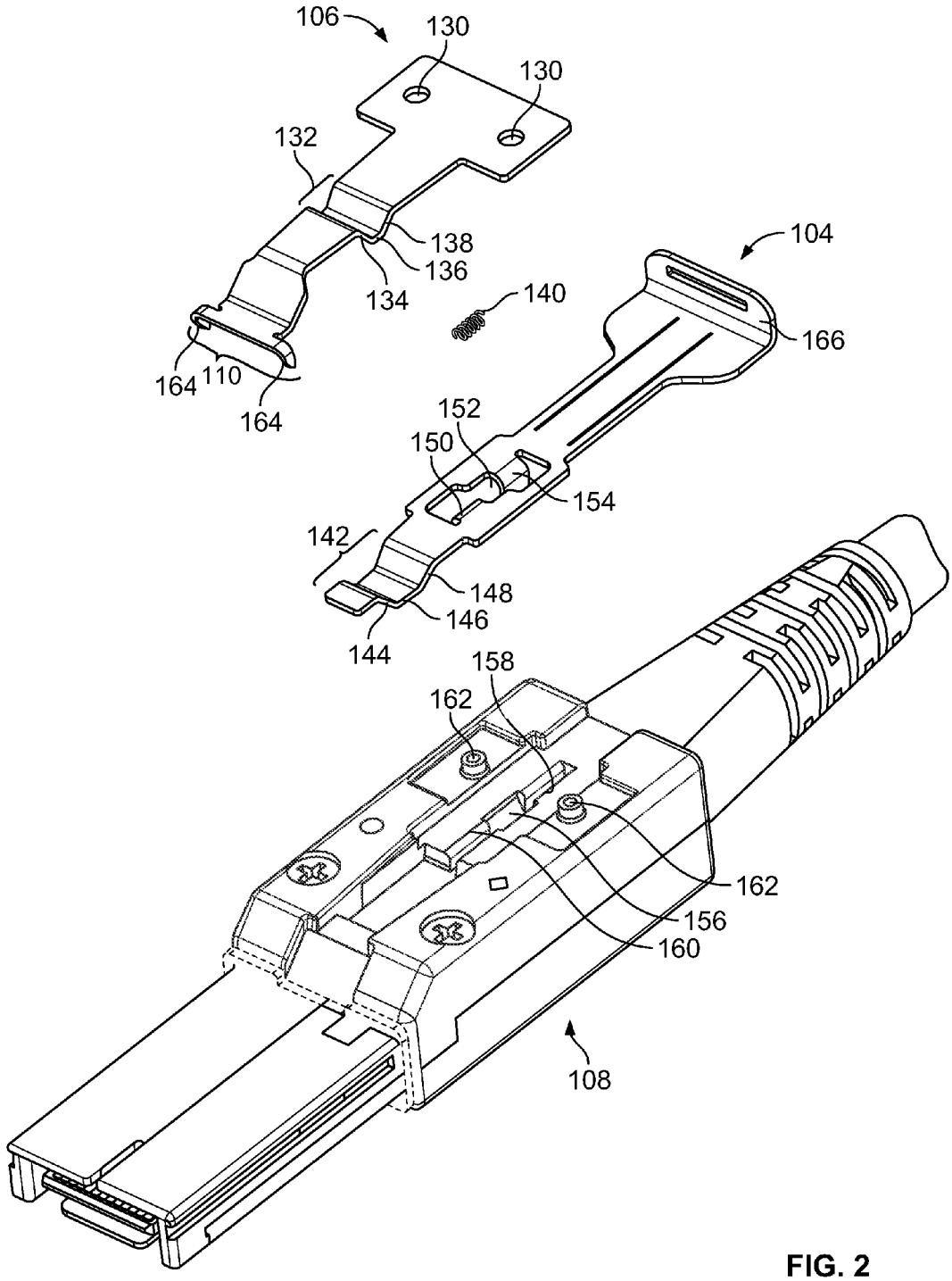
FIG. 2 is an exploded view of the bi-directional push/pull electrical plug assembly.

FIG. 2 is an exploded view of the bi-directional push/pull electrical plug assembly 100. The actuator 104 includes a guide track 142 that moves relative to a driven member 132 of the latch 106 when the actuator 104 is pushed in the push direction 118 and pulled in the pull direction 120. The guide track 142 includes a distal guide ramp 144, a flat portion 146 and a proximal guide ramp 148. The distal guide ramp 144 and the proximal guide ramp 148 are oppositely sloped ramps. The driven member 132 includes a distal driven ramp 134, a flat portion 136 and a proximal driven ramp 138. The distal driven ramp 134 and the proximal driven ramp 138 also are oppositely sloped ramps. Alternatively, the driven member 132 does not include the flat portion 136.

A pair of mounting holes 130 in the latch 106 are placed over a pair of mounting pins 162 that extend from the housing 108. The mounting pins 162 secure the latch 106 over the actuator 104 and secure the latch 106 to the housing 108. The mounting pins 162 may include any of a variety of fastening devices, including shank and rivet combinations or screws, for example.

In operation, the actuator 104 is pushed in the push direction 118 and pulled in the pull direction 120 to cause the guide track 142 to move along the driven member 132. The actuator 104 includes a handle 166 that is configured to be pushed in the push direction 118 and pulled in the pull direction 120. As the guide track 142 moves along the driven member 132, the guide track 142 deflects the driven member 132 partially upwards when either one of the opposing ends of the guide track 142 reaches the driven member 132. For example, the guide track 142 deflects the driven member 132 partially upwards, or loads the driven member 132, when either of the distal guide ramp 144 or the proximal guide ramp 148 reaches the driven member 132. As the guide track 142 deflects the driven member 132 partially upwards, the driven member 132 forces the latching end 110 of the latch 106 to unlatch from the receptacle 114.

Figure 4:
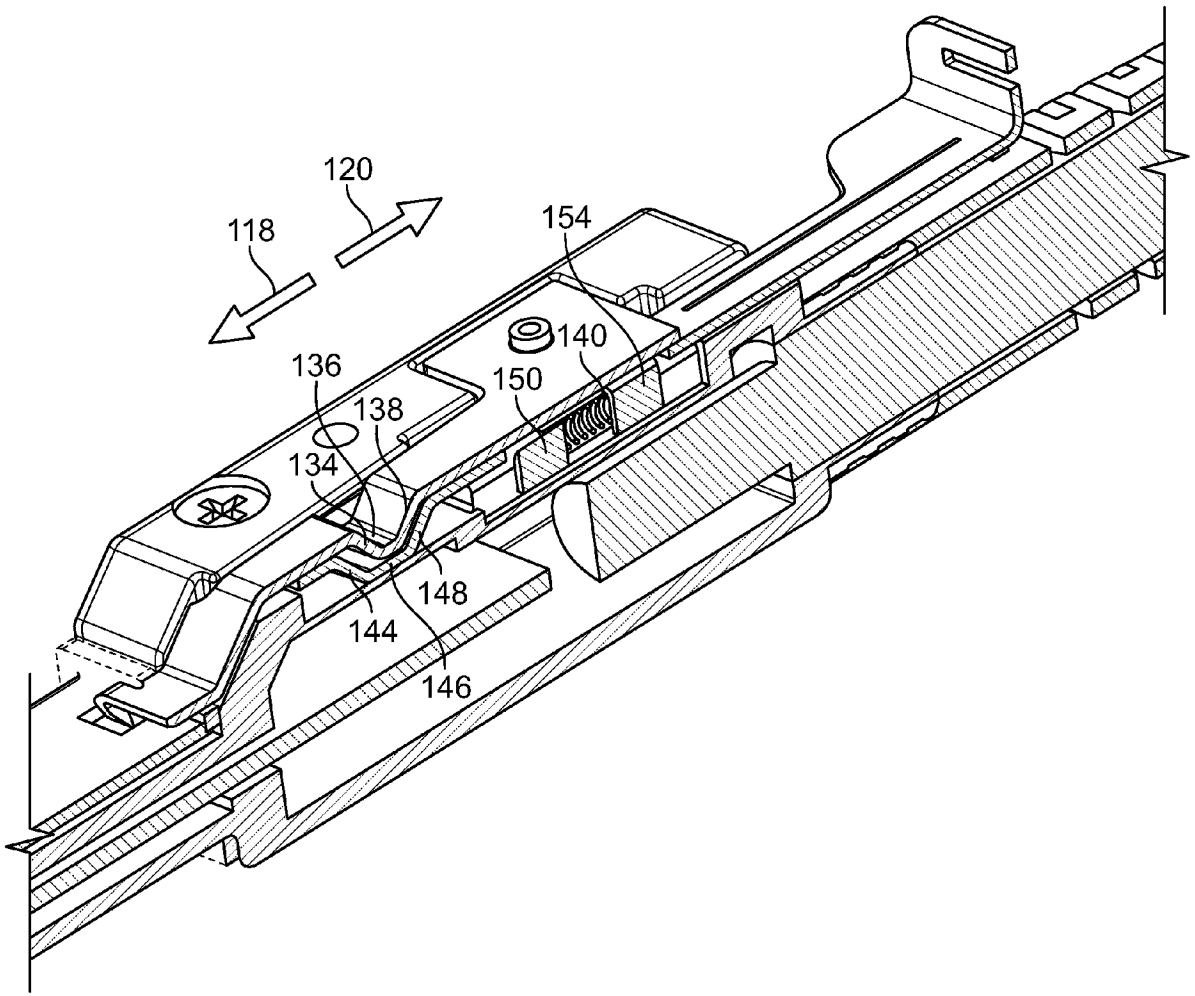
FIG. 4 is a cross-sectional view of the bi-directional push/pull electrical plug assembly.

In one embodiment, the actuator 104 includes a spring 140 configured to force the actuator 104 in an opposite direction after the actuator 104 has been pushed in the push direction 118 or pulled in the pull direction 120. That is, when the actuator 104 is pulled in the pull direction 120 and then released, the spring 140 moves the actuator 104 back in the push direction 118 to a neutral position. The actuator 104 is in the neutral position when the driven member 132 is not loaded by either one of the guide ramps 144, 148. The neutral position is illustrated in FIG. 4, which is described below.

Conversely, when the actuator 104 is pushed in the push direction 118 and then released, the spring 140 moves the actuator 104 back in the pull direction 120 to the neutral position. In doing so, the spring 104 lowers the driven member 132 and the latching end 110 of the latch 106 when the actuator 104 is released. The spring 140 is held in place by a pair of spring-retaining arms 150 and 154 located proximate a center opening 152 in the actuator 104. For example, the spring 140 may be at least partially compressed between the spring-retaining arms 150 and 154.

The housing 108 includes a channel 156 that receives the spring 140 and the spring retaining arms 150 and 154 of the actuator 104. The channel 156 is elongated along the push direction 118 and pull direction 120 (shown in FIG. 1). The spring retaining arms 150 and 154 of the actuator 104 travel along the channel 156 when the actuator 104 is pushed in the push direction 118 and pulled in the pull direction 120.

Figure 3:
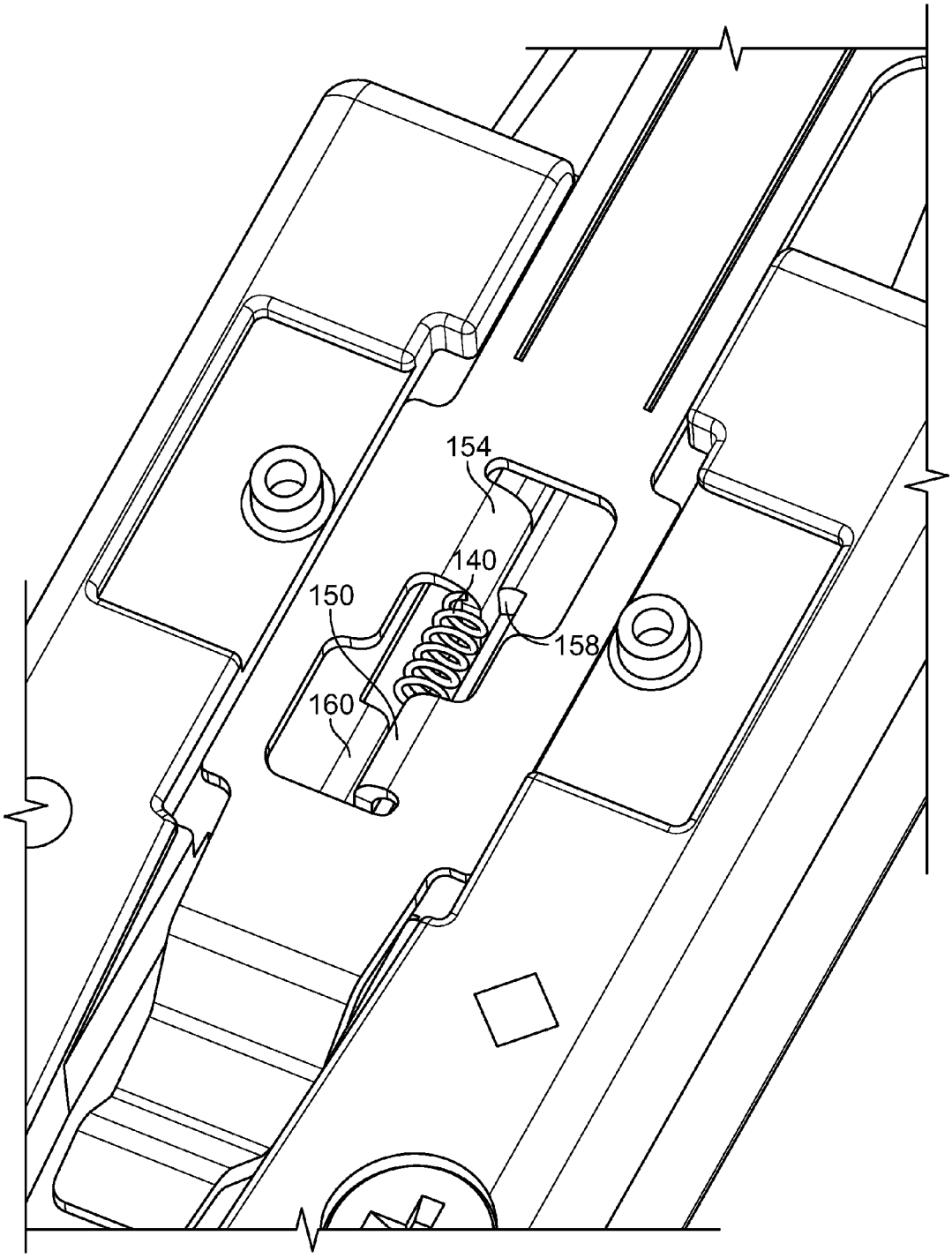
FIG. 3 is a top view of the bi-directional push/pull electrical plug assembly with the latch removed.

FIG. 3 is a top view of the bi-directional push/pull electrical plug assembly 100 with the latch 106 removed. The channel 156 includes two spring stops 158 and 160 on opposite sides of the channel 156. The first spring stop 158 is located proximate the end of the channel 156 closest to the terminating end 102 of the cable. The second spring stop 160 is located proximate the end of the channel 156 closest to the mating end 112 of the assembly 100 (shown in FIG. 1).

As described in more detail below, the first spring stop 158 contacts the spring 140 when the actuator 104 is pulled in the pull direction 120 (shown in FIG. 1). The second spring stop 160 contacts the spring 140 when the actuator 104 is pushed in the push direction 118 (shown in FIG. 1).

FIG. 4 is a cross-sectional view of the bi-directional push/pull electrical plug assembly 100. The actuator 104 is shown in FIG. 4 in the neutral position. In the neutral position, the flat portion 136 of the driven member 132 is in a substantially central position between the guide ramps 144, 148 of the guide track 142. In this neutral position, the latching end 110 of the latch 106 (shown in FIG. 1) is unbiased.

Figure 5:
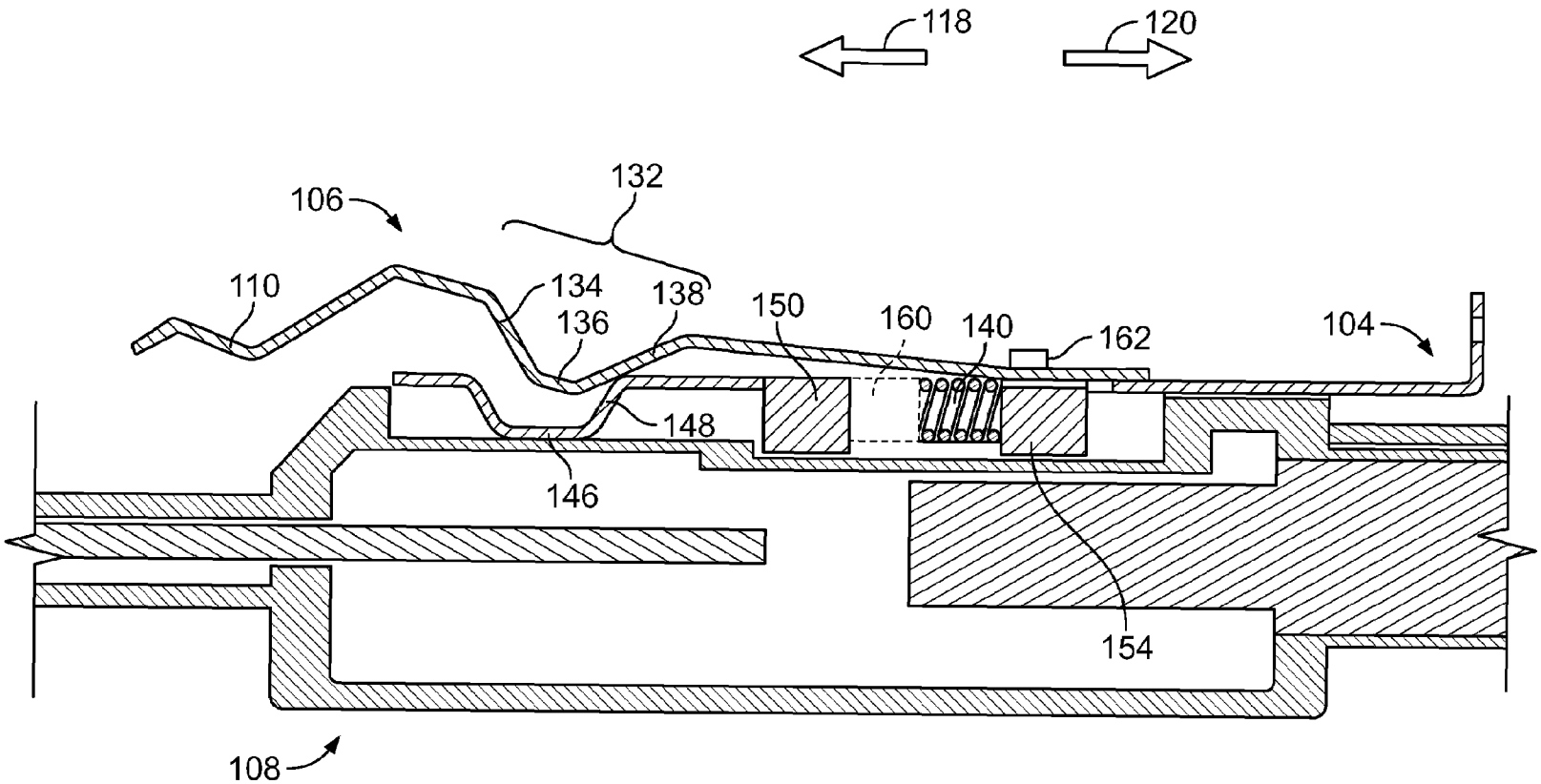
FIG. 5 is a cross-sectional view of the bi-directional push/pull electrical plug assembly with the actuator pushed in the push direction.

FIG. 5 is a cross-sectional view of the bi-directional push/pull electrical plug assembly 100 with the actuator 104 pushed in the push direction 118. The guide track 142 (including the flat portion 146 and the proximal guide ramp 148) moves in the push direction 118 when the actuator 104 is pushed in the push direction 118. The driven member 132 slides along the guide track 142 until the driven member 132 contacts and slides along and up the proximal guide ramp 148 of the guide track 142. For example, the proximal driven ramp 138 and/or the flat portion 136 of the driven member 132 may be deflected upwards by the proximal guide ramp 148 of the guide track 142. As the proximal driven ramp 138 and the flat portion 146 are biased upwards by the proximal guide ramp 148 of the guide track 142, the driven member 132 is raised away from the housing 108. When the driven member 132 is raised, the latching end 110 of the latch 106 also is raised.

Additionally, when the actuator 104 is pushed in the push direction 118, the spring retaining arm 154 also moves in the push direction 118 while the second spring stop 160 remains stationary. As the actuator 104 continues to be pushed in the push direction 118, the spring 140 contacts the second spring stop 160. If the actuator 104 continues to be pushed in the push direction 118, the spring 140 is compressed between the second spring stop 160 and the spring retaining arm 154.

The spring 140 prevents the actuator 104 from being pushed too far in the push direction 118. For example, the spring 140 can be fully compressed between the second spring stop 160 and the spring retaining arm 154. At that point, the spring 140 does not permit any additional movement of the spring retaining arm 154 or the actuator 104 in the push direction 118.

In one embodiment, the distance between the spring retaining arm 154 and the second spring stop 160 is small enough to prevent the driven member 132 from moving past the guide track 142. That is, the distance that the actuator 104 can be pushed in the push direction 118 can be limited so that the driven member 132 does not slide up and past the proximal guide ramp 148.

If the actuator 104 is released with the spring 140 at least partially compressed, the spring 140 pushes against the spring retaining arm 154 and forces the actuator 104 in the pull direction 120 back to the neutral position (shown in FIG. 4). As the actuator 104 is forced in the pull direction 120, the guide track 142 also moves in the pull direction 120. As the guide track 142 moves in the pull direction 120, the driven member 132 slides down the proximal guide ramp 148 and lowers until the driven member 132 is unloaded from the proximal guide ramp 148. As the driven member 132 slides down the proximal guide ramp 148 to the flat portion 146, the latching end 110 also lowers towards the mating end 112 of the assembly 100.

Figure 6:
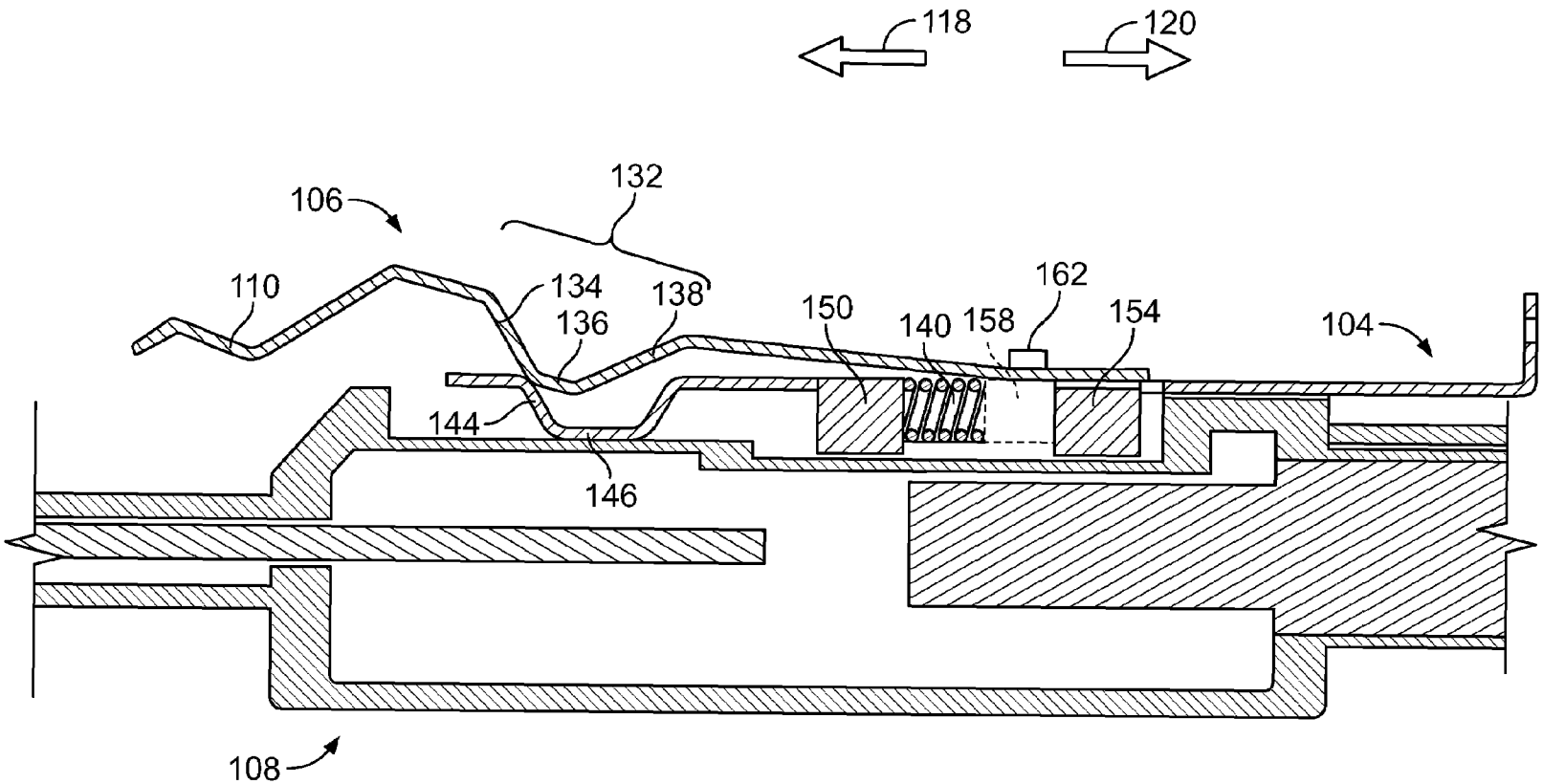
FIG. 6 is a cross-sectional view of the bi-directional push/pull electrical plug assembly with the actuator pulled in the pull direction.

FIG. 6 is a cross-sectional view of the bi-directional push/pull electrical plug assembly 100 with the actuator 104 pulled in the pull direction 120. The guide track 142 (including the flat portion 146 and distal guide ramp 144) moves in the pull direction 120 when the actuator 104 is pulled in the pull direction 120. The driven member 132 slides along the guide track 142 until the driven member 132 contacts and slides along and up the distal guide ramp 144 of the guide track 142. For example, the distal driven ramp 134 and/or the flat portion 136 of the driven member 132 may be deflected upwards by the distal guide ramp 144 of the guide track 142. As the driven member 132 is deflected upwards, the driven member 132 is raised away from the housing 108. When the driven member 132 is raised, the latching end 110 of the latch 106 also is raised.

Additionally, when the actuator 104 is pulled in the pull direction 120, the spring retaining arm 150 also moves in the pull direction 120 while the first spring stop 158 remains stationary. As the actuator 104 continues to be pulled in the pull direction 120, the spring 140 contacts the first spring stop 158. If the actuator 104 continues to be pulled in the pull direction 120, the spring 140 is compressed between the first spring stop 158 and the spring retaining arm 150.

The spring 140 prevents the actuator 104 from being pulled too far in the pull direction 120. For example, the spring 140 can be fully compressed between the first spring stop 158 and the spring retaining arm 150. At that point, the spring 140 does not permit any additional movement of the spring retaining arm 150 or the actuator 104 in the pull direction 120.

In one embodiment, the distance between the spring retaining arm 150 and the first spring stop 158 is small enough to prevent the driven member 132 from moving past the guide track 142. That is, the distance that the actuator 104 can be pulled in the pull direction 120 can be limited so that the driven member 132 does not slide up and past the distal guide ramp 144.

If the actuator 104 is released with the spring 140 at least partially compressed, the spring 140 pushes against the spring retaining arm 150 and forces the actuator 104 in the push direction 118 back to the neutral position (shown in FIG. 4). As the actuator 104 is forced in the push direction 118, the guide track 142 also moves in the push direction 118. As the guide track 142 moves in the push direction 118, the driven member 132 slides down the distal guide ramp 144 and is unloaded from the distal guide ramp 144. As the driven member 132 is unloaded from the distal guide ramp 144, the latching end 110 lowers towards the mating end 112 of the assembly 100.

In an alternative embodiment, the assembly 100 is provided without the spring 140. In such an embodiment, the latching end 110 of the latch 106 may automatically lower and latch with the receptacle 114 due to a downward force exerted by the latch 106 on the driven member 132 when the latching end 110 has been raised. As described above, when the actuator 104 is pushed in the push direction 118 and when the actuator 104 is pulled in the pull direction 120, the driven member 132 and latching end 110 of the latch 106 are deflected upwards away from the housing 108.

When the latching end 110 is raised away from the housing 108, the latch 106 flexes about the mounting pins 162. When the actuator 104 is released, the latching end 110 of the latch 106 is no longer biased upwards. If the actuator 104 was pushed in the push direction 118 to raise the latching end 110 of the latch 106, the latch 106 then releases and forces the driven member 132 down the proximal guide ramp 148 (shown in FIG. 5). On the other hand, if the actuator 104 was pulled in the pull direction 120 to raise the latching end 110 of the latch 106, the latch 106 then releases and forces the driven member 132 down the distal guide ramp 144 (shown in FIG. 6).

In either case, the driven member 132 slides down the distal guide ramp 144 or proximal guide ramp 148 until the driven member 132 is no longer loaded by the guide track 142 or otherwise biased upwards by the guide track 142. When the driven member 132 is no longer loaded by the guide track 142, the actuator 104 is in the neutral position (shown in FIG. 4) and the latching end 110 of the latch 106 is lowered and latches with the holes 116 in the receptacle 114.

In one embodiment, pushing the actuator 104 in the push direction 118 and pulling the actuator 104 in the pull direction 120 raises the latching end 110 of the latch 106 an equal amount. For example, the angle and length of the proximal and distal guide ramps 148, 144 can be the same so that the driven member 132 is biased a similar amount regardless of whether the actuator 104 is pushed in the push direction 118 or pulled in the pull direction 120.

Alternatively, the proximal guide ramp 148 and the distal guide ramp 144 of the guide track 142, and the proximal driven ramp 138 and the distal driven ramp 134, slope in opposite directions. That is, as shown in FIG. 2, the distal driven ramp 134 and the distal guide ramp 144 slope downwards and the proximal driven ramp 138 and the proximal guide ramp 148 slope upwards. In another embodiment, the distal driven ramp 134 and the distal guide ramp 144 slope upwards and the proximal driven ramp 138 and the proximal guide ramp 148 slope downwards.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical plug assembly comprising:

a housing extending along a longitudinal axis, the housing being configured to mate with a receptacle assembly;

a latch movably coupled to the housing, the latch having a latching end configured to latch and unlatch with the receptacle assembly; and an actuator interconnected with the housing and the latch, the actuator being movable in both a push direction and a pull direction, the actuator raising the latching end when the actuator is pushed along the longitudinal axis in the push direction, the actuator raising the latching end when the actuator is pulled along the longitudinal axis in the pull direction, the push direction and the pull direction differing from one another.

2. The plug assembly according to claim 1, wherein the push and pull directions are diametrically opposed to one another.

3. The plug assembly according to claim 1, wherein one of the latch and actuator includes a driven member and the other of the latch and actuator includes a guide track, the guide track moving along the driven member and the driven member moving partially upward out of the guide track when one of opposing ends of the guide track reaches the driven member, the driven member forcing the latch to unlatch from the receptacle assembly when the driven member moves partially upward out of the guide track.

4. The plug assembly according to claim 3, wherein the guide track includes a pair of oppositely sloped guide ramps and the driven member includes a pair of oppositely sloped driven ramps, a first of the guide ramps sliding along a first of the driven ramps when the actuator is pushed in the push direction and a second of the guide ramps sliding along a second of the driven ramps when the actuator is pulled in the pull direction.

5. The plug assembly according to claim 1, further comprising a spring that moves the actuator in the pull direction to latch the latching end to the receptacle assembly after the actuator is pushed in the push direction and that moves the actuator in the push direction to latch the latching end to the receptacle assembly after the actuator is pulled in the pull direction.

6. The plug assembly according to claim 5, wherein the actuator includes a plurality of spring-retaining arms and the spring is disposed between the arms.

7. The plug assembly according to claim 6, wherein the housing includes a channel configured to receive the spring-retaining arms as the arms move in the push direction and in the pull direction.

8. The plug assembly according to claim 6, wherein housing includes first and second stops, the first stop configured to compress the spring against a first one of the spring-retaining arms when the actuator is pushed in the push direction, the second stop configured to compress the spring against a second one of the spring-retaining arms when the actuator is pulled in the pull direction.

9. An electrical plug assembly comprising:

a latching end configured to latch with a receptacle assembly; and an actuator movable in both a push direction and a pull direction, the actuator unlatching the latching end from the receptacle assembly when the actuator is pushed in a push direction along a longitudinal axis of the electrical plug assembly, the actuator unlatching the latching end from the receptacle assembly when the actuator is pulled in a pull direction along the longitudinal axis, the push direction and the pull direction differing from one another.

10. The plug assembly according to claim 9, wherein the push and pull directions are diametrically opposed to one another.

11. The plug assembly according to claim 9, further including a driven latch member interconnected with the latching end, wherein the actuator includes a guide track, the guide track moving along the driven member and the driven member moving partially upward out of the guide track when one of opposing ends of the guide track reaches the driven member, the driven member forcing the latching end to unlatch from the receptacle assembly when the driven member moves partially upward out of the guide track.

12. The plug assembly according to claim 11, wherein the guide track includes a pair of oppositely sloped guide ramps and the driven member includes a pair of oppositely sloped driven ramps, a first of the guide ramps sliding along a first of the driven ramps when the actuator is pushed in the push direction and a second of the guide ramps sliding along a second of the driven ramps when the actuator is pulled in the pull direction.

13. The plug assembly according to claim 9, further comprising a spring that latches the latching end to the receptacle assembly after the actuator is pushed in the push direction and after the actuator is pulled in the pull direction.

14. The plug assembly according to claim 13, wherein the actuator includes a plurality of spring-retaining arms and the spring is disposed between the arms.

15. An electrical plug assembly comprising:

a latch connected to a latching end, the latching end configured to latch with a receptacle assembly; and a guide track movable along a longitudinal axis of the electrical plug assembly in a push direction and in a pull direction, the guide track unlatching the latching end from the receptacle assembly when the guide track is moved in the push direction and when the guide track is moved in the pull direction; and wherein the push direction and the pull direction are differing from one another.

16. The plug assembly according to claim 15, wherein the push and pull directions are diametrically opposed to one another.

17. The plug assembly according to claim 15, wherein the latch includes a driven member, the guide track moving along the driven member and the driven member moving partially upward out of the guide track when one of opposing ends of the guide track reaches the driven member, the driven member forcing the latching end to unlatch from the receptacle assembly when the driven member moves partially upward out of the guide track.

18. The plug assembly according to claim 17, wherein the guide track includes a pair of oppositely sloped guide ramps, a first of the guide ramps sliding along the driven member when the guide track is moved in the push direction and a second of the guide ramps sliding along the driven member when the guide track is moved in the pull direction.

19. The plug assembly according to claim 17, wherein the driven member includes a pair of oppositely sloped driven ramps, a first of the driven ramps sliding up one side of the guide track when the guide track is moved in the push direction and a second of the driven ramps sliding along an opposite side of the guide track when the guide track is moved in the pull direction.

20. The plug assembly according to claim 15, further comprising a spring that moves the guide track in the pull direction to latch the latching end to the receptacle assembly after the guide track is moved in the push direction and that moves the guide track in the push direction to latch the latching end to the receptacle assembly after the guide track is moved in the pull direction.

* * * * *

UNITED STATES PATENT AND TRADEMARK OFFICE

CERTIFICATE OF CORRECTION

PATENT NO. : 7,473,124 B1
APPLICATION NO. : 12/040395
DATED : January 6, 2009
INVENTOR(S) : Eric David Briant et al.

It is certified that error appears in the above-identified patent and that said Letters Patent is hereby corrected as shown below:

Title page, item [75] inventors: Daniel Lee's address should be –6100 Chatham Court, Harrisburg, Pennsylvania 17111

Signed and Sealed this

Ninth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,473,124 B1
APPLICATION NO. : 12/040395
DATED : January 6, 2009
INVENTOR(S) : Eric David Briant et al.

It is certified that error appears in the above-identified patent and that said Letters Patent is hereby corrected as shown below:

Title page, item [75] inventors: Daniel Lee Gorenc address should be –6100 Chatham Court, Harrisburg, Pennsylvania 17111

This certificate supersedes the Certificate of Correction issued February 9, 2010.

Signed and Sealed this

Thirtieth Day of March, 2010

David J. Kappos

David J. Kappos
*Director of the United States Patent and Trademark Office*